US007845725B1

(12) United States Patent
Sawhney

(10) Patent No.: US 7,845,725 B1
(45) Date of Patent: Dec. 7, 2010

(54) OPEN ARCHITECTURE SEATING SYSTEM

(75) Inventor: Ravi K. Sawhney, Calabasas, CA (US)

(73) Assignee: RKS Design, Inc., Thousand Oaks, CA (US)

( * ) Notice: Subject to any disclaimer, the term of this patent is extended or adjusted under 35 U.S.C. 154(b) by 289 days.

(21) Appl. No.: 11/205,503

(22) Filed: Aug. 16, 2005

(51) Int. Cl.
*A47C 15/00* (2006.01)

(52) U.S. Cl. ..... 297/248; 297/257

(58) Field of Classification Search ..... 297/344.1, 297/232, 248, 257, 452, 452.63, 263, 383, 297/217.7, 14, 452.39, 452.4
See application file for complete search history.

(56) References Cited

U.S. PATENT DOCUMENTS 3,619,004 A * 11/1971 McKernan et al. ..... 297/248
4,235,473 A * 11/1980 Aginar ..... 297/440.19
4,277,101 A * 7/1981 Vogel ..... 297/232
5,284,379 A * 2/1994 Arnold et al. ..... 297/113
5,292,177 A 3/1994 Balderi et al.
5,671,975 A * 9/1997 Muller ..... 297/445.1
5,673,973 A * 10/1997 Marechal ..... 297/452.4
5,769,360 A * 6/1998 Kerbis et al. ..... 244/118.6
5,794,383 A 8/1998 Labinski
5,829,836 A * 11/1998 Schumacher et al. ..... 297/257
5,882,069 A 3/1999 Gunnett et al.
5,957,529 A * 9/1999 Schrewe ..... 297/232
6,095,603 A * 8/2000 Hock ..... 297/232
6,296,315 B1 * 10/2001 Jensen ..... 297/452.14

FOREIGN PATENT DOCUMENTS

EP 470036 A1 * 2/1992
WO WO 9849924 A1 * 11/1998

OTHER PUBLICATIONS

Douglas Ball, Flyaway Public Seating, Website Printout, 12 pages, www.arconas.com.

* cited by examiner

*Primary Examiner*—David Dunn
*Assistant Examiner*—Tania Abraham
(74) *Attorney, Agent, or Firm*—Daniel P. Dooley; Fellers, Snider, et al.

(57) ABSTRACT

An apparatus for use in accommodating public seating needs is disclosed. Preferably, the apparatus includes at least a pair of parallel backbone members, a support leg in sliding engagement with the pair of parallel backbone members, a combination seating surface and backrest portion in sliding engagement with the pair of parallel backbone members, and adjacent the support leg, and an end cap secured to the pair of parallel backbone members, and restricting lateral motion of the support leg and the combination seating surface and backrest portion along the pair of parallel backbone members. Preferably the apparatus further accommodates lateral motion of the support leg and the combination seating surface and backrest portion along the pair of parallel backbone members, upon removal of the end cap from the pair of parallel backbone members.

20 Claims, 6 Drawing Sheets

OPEN ARCHITECTURE SEATING SYSTEM

FIELD OF THE INVENTION

This invention relates to seating systems, and in particular, but not by way of limitation, to an open architecture public seating system having an ability to provide versatility and minimal efforts for servicing public seating needs.

BACKGROUND

Public seating accommodations have taken on a variety of forms over time, from park benches, to sport stadium seating, to airport waiting area seating. A common feature of each type of prior art seating arrangements, is the use of a plurality of fasteners to secure the seating portions, backrest portions, and armrest portions to a base support. By rigidly securing the various portions to the base support, maintenance of the seating systems becomes an expensive and daunting task.

Accordingly, as market pressures continue to demand seating systems that provide lower cost, greater reliability, and improved ease of use, challenges remain and a need persists for improvements in methods and apparatuses for use in accommodating demands for public seating.

SUMMARY OF THE INVENTION

In accordance with preferred embodiments, an apparatus includes a pair of parallel backbone members, at least one support leg, which slides into mating contact with the pair of parallel backbone members, a combination seating surface and backrest portion in sliding engagement with the pair of parallel backbone members, and adjacent the support leg, and an end cap preferably secured to each of the pair of parallel backbone members with removable fasteners.

The end cap preferably abuts the combination seating surface and backrest portion and restricts lateral motion of both the support leg and the combination seating surface and backrest portion along the pair of parallel backbone members. Preferably, through the use of removable fasteners, the apparatus further accommodates lateral motion of the support leg and the combination seating surface and backrest portion along the pair of parallel backbone members, upon removal of the end cap from the pair of parallel backbone members.

By removing the end cap, both the support leg and the combination seating surface and backrest portion may be easily removed from the pair of parallel backbone members for repair and maintenance, or to be exchanged with support legs and the combination seating surface and backrest portions of alternate styles and looks to accommodate changes in architectural and design themes.

These and various other features and advantages that characterize the claimed invention will be apparent upon reading the following detailed description and upon review of the associated drawings.

DETAILED DESCRIPTION

Detailed descriptions of the preferred embodiments are provided herein. It is to be understood, however, that the present invention may be embodied in various forms. Various aspects of the invention may be inverted, or changed in reference to specific part shape and detail, part location, or part composition. Therefore, specific details disclosed herein are not to be interpreted as limiting, but rather as a basis for the claims and as a representative basis for teaching one skilled in the art to employ the present invention in virtually any appropriately detailed system, structure, or manner.

Figure 1:
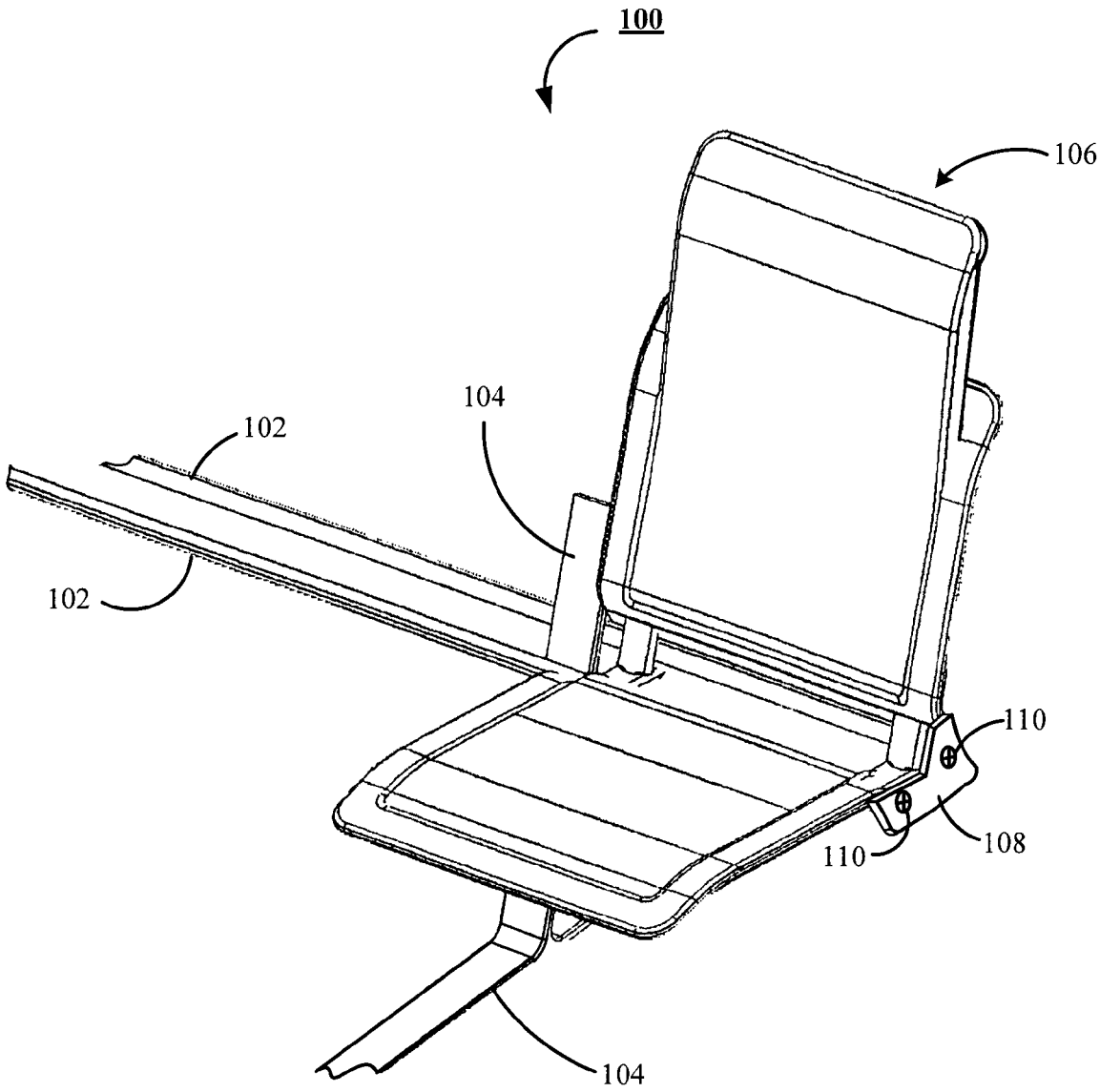
FIG. 1 shows a partial cut-away top perspective view of an inventive open architecture public seating system of the present invention.

Reference will now be made in detail to one or more examples of the invention depicted in the figures. Each example is provided by way of explanation of the invention, and not meant as a limitation of the invention. FIG. 1 shows an inventive open architecture public seating system 100, which preferably includes a pair of parallel backbone members 102, at least one support leg 104, which slides into mating contact with the pair of parallel backbone members 102, a combination seating surface and backrest portion 106 (also referred to herein as a unitary combination seating surface and backrest portion 106), in sliding engagement with the pair of parallel backbone members 102, and adjacent the support leg 104, and an end cap 108, preferably secured to each of the pair of parallel backbone members 102 with removable fasteners 110.

Figure 2:
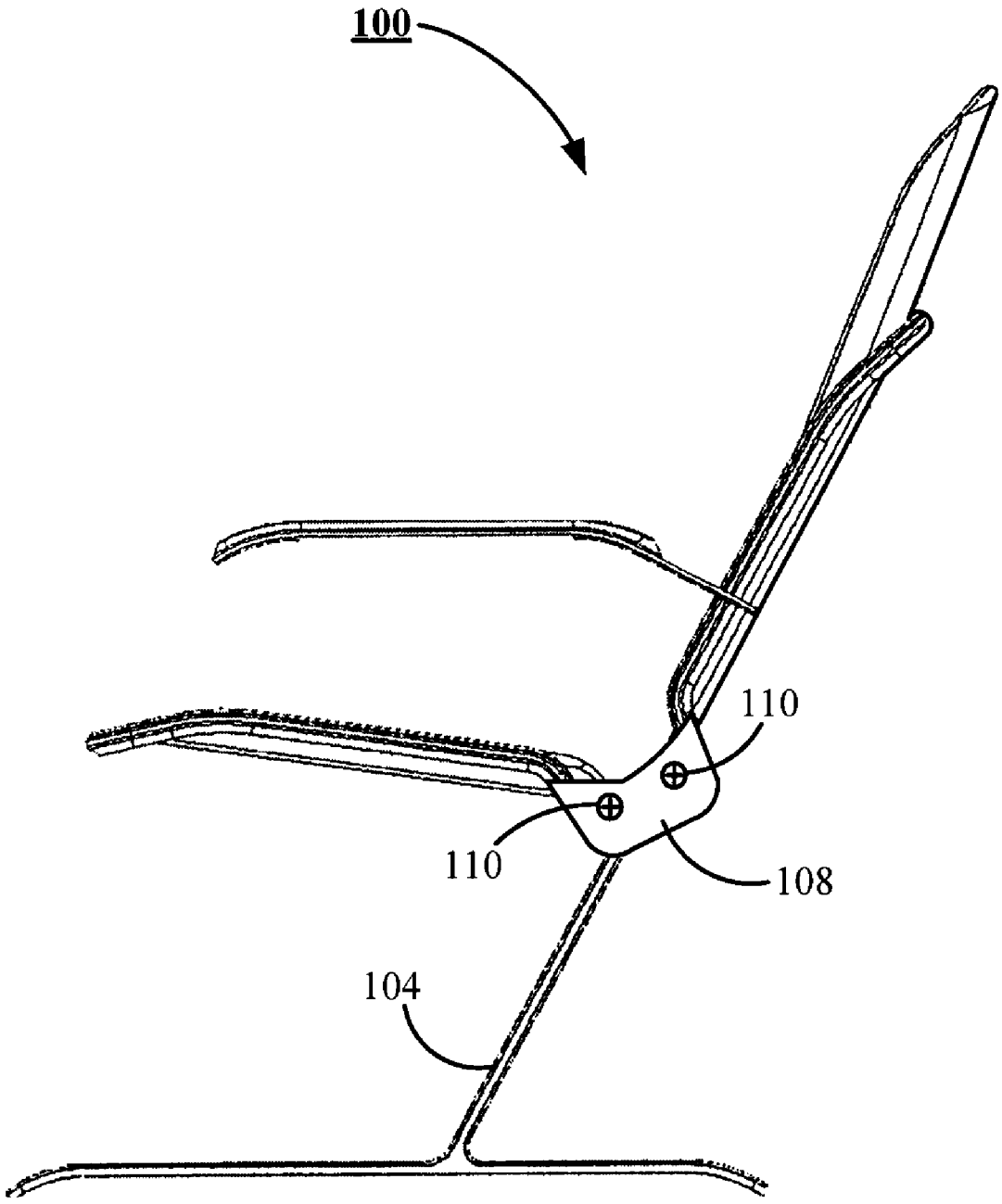
FIG. 2 shows an elevational end view of the inventive open architecture public seating system of FIG. 1.
Figure 3:
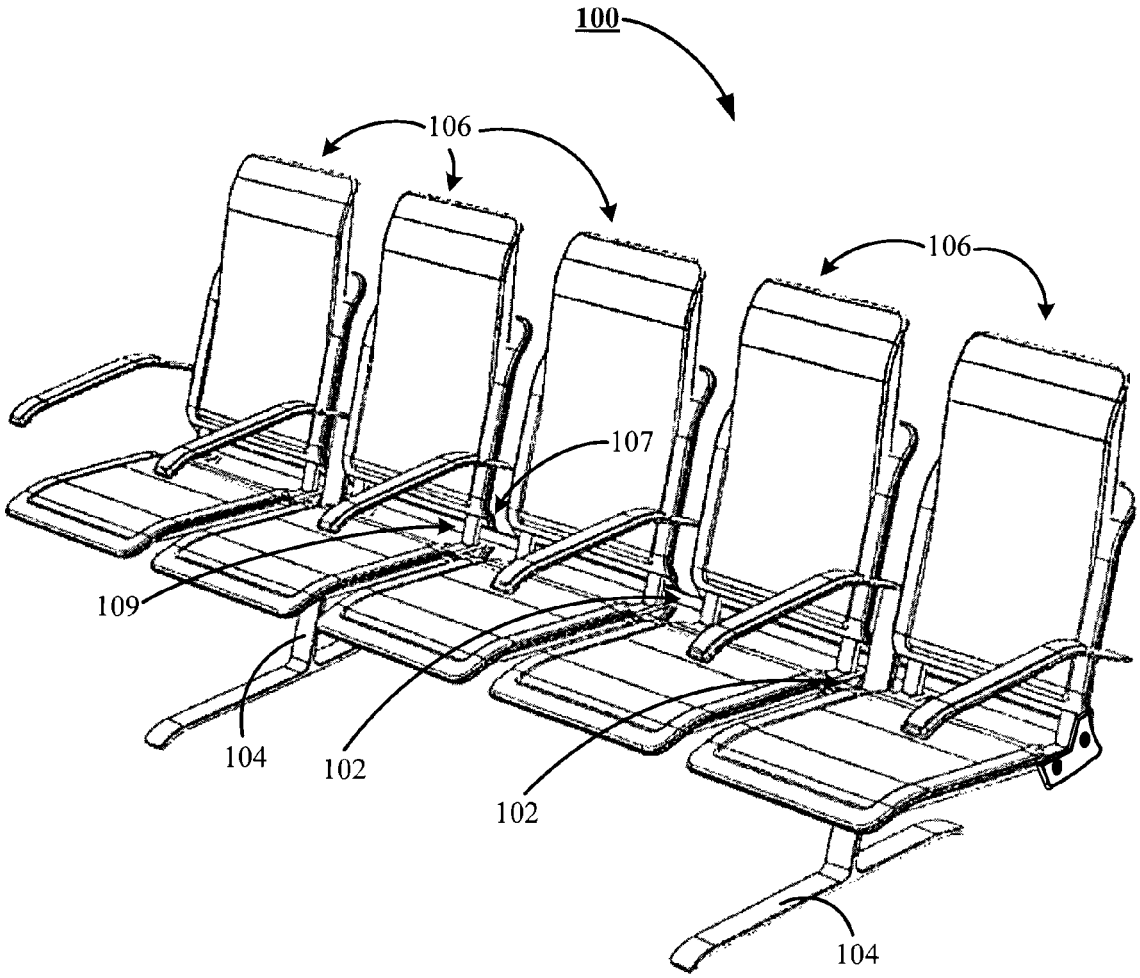
FIG. 3 shows a top perspective view of a plurality of combination seating surface and backrest portion accommodated by the inventive open architecture public seating system of FIG. 1.

FIG. 2 provides a more clear perspective of the end cap 108, and the removable fasteners 110, in relation to the pair of parallel backbone members 102. FIG. 3 shows a plurality of combination seating surface and backrest portions 106, supported by the pair of parallel backbone members 102, which collectively form an inline public seating accommodations presentation of the present inventive open architecture public seating system 100. In addition, FIG. 3 shows the pair of backbone members 102 positioned in the pair of mounting apertures 109, which are integral to each combination seating surface and backrest portion 106, that form the sliding engagement area 107.

Figure 4:
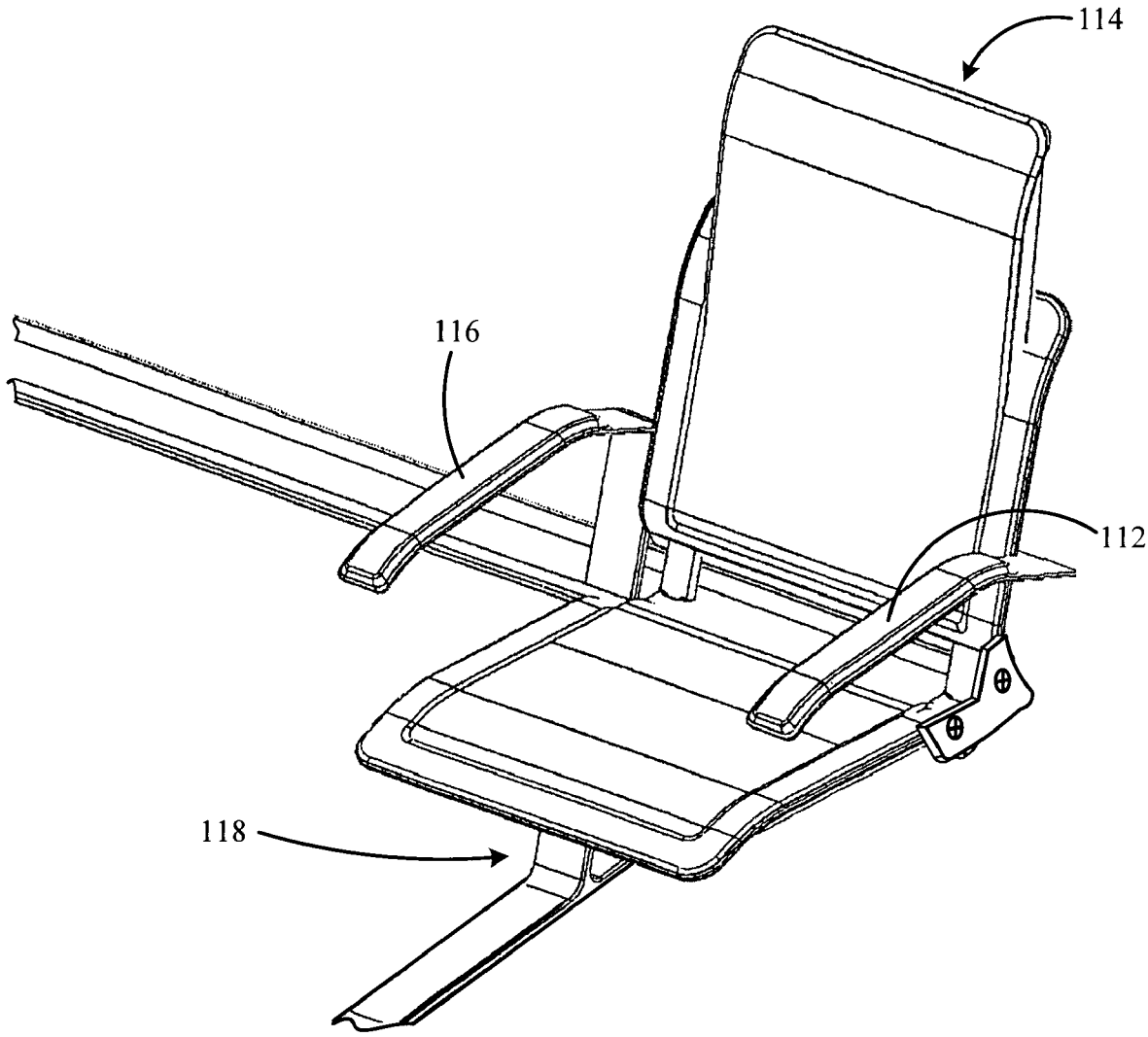
FIG. 4 shows a partial cut-away top perspective view of an armrest integrated into a support leg portion of the inventive open architecture public seating system of FIG. 1.

FIG. 4 shows a first armrest 112, integrated into the combination seating surface and backrest portions 106, to form a form a combination seating surface, backrest portion, and armrest portion 114 (also referred to herein as a unitary combination seating surface, backrest portion, and armrest portion 114), and a second armrest 116, integrated with the support leg 104, to form an alternate embodiment of a support leg 118.

Figure 5:
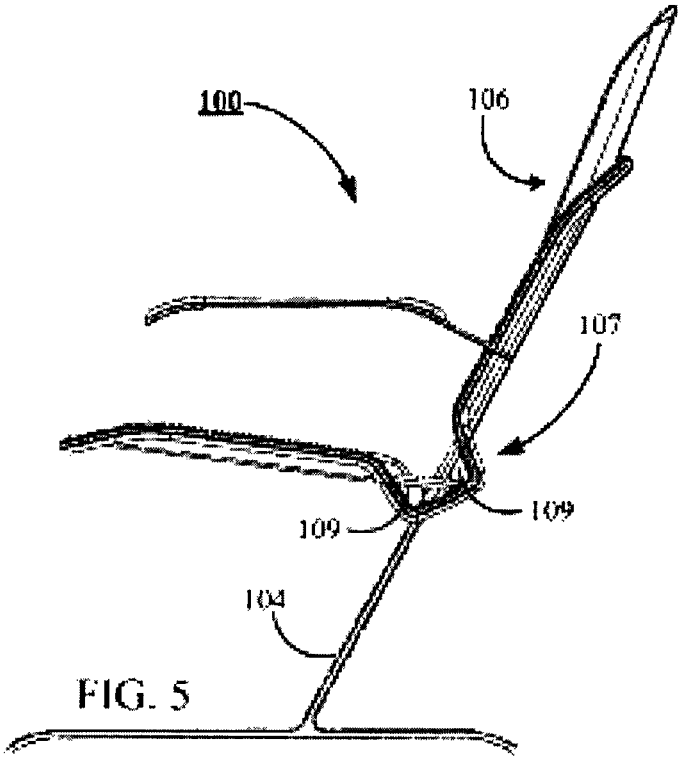
FIG. 5 shows an elevational end view with the end cap and fasteners removed from the inventive open architecture public seating system of FIG. 1.
Figure 6:
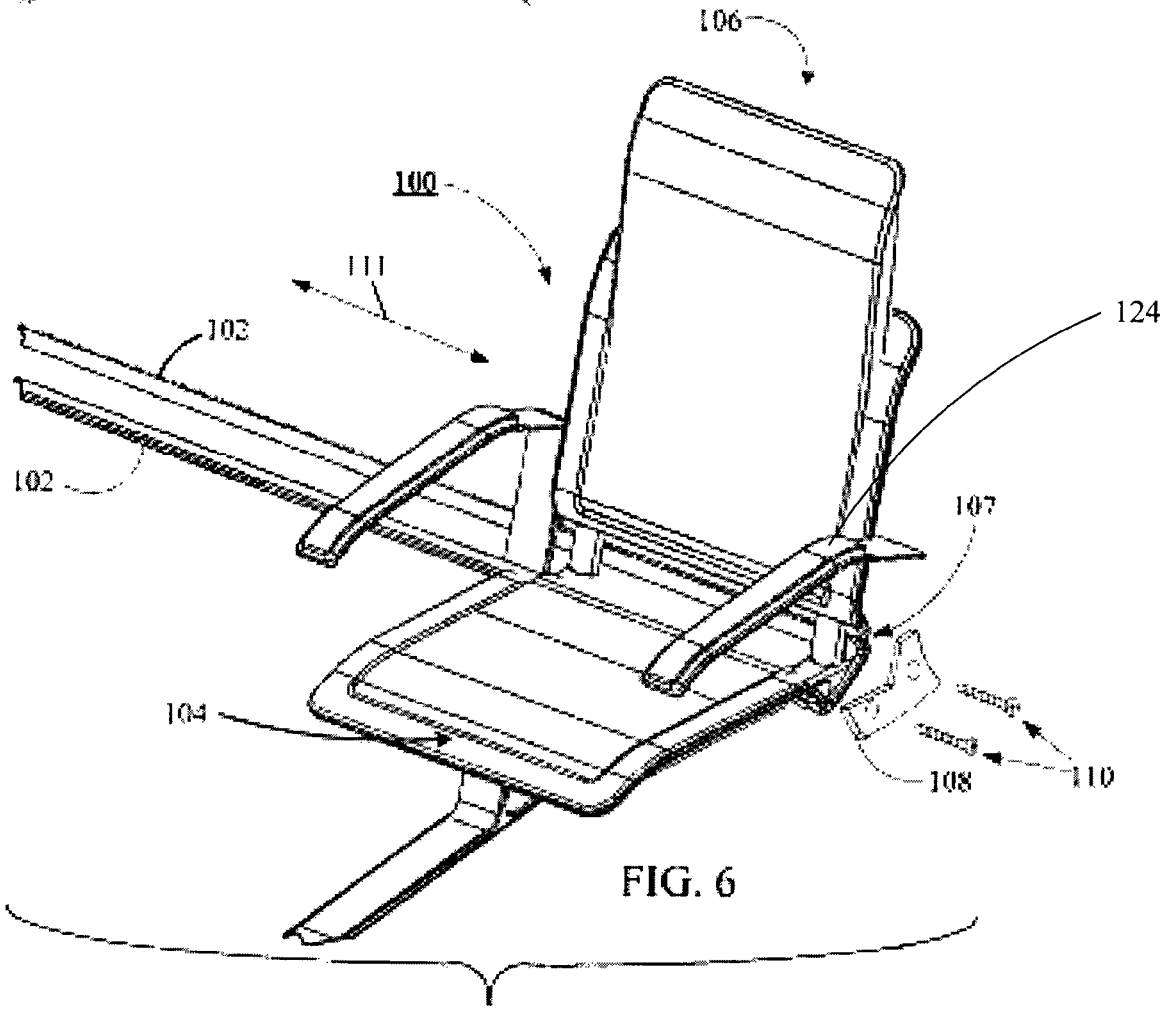
FIG. 6 shows a partial cut-away top perspective exploded view of the sliding engagement area, end cap, and removable fasteners of the inventive open architecture public seating system of FIG. 1.
Figure 7:
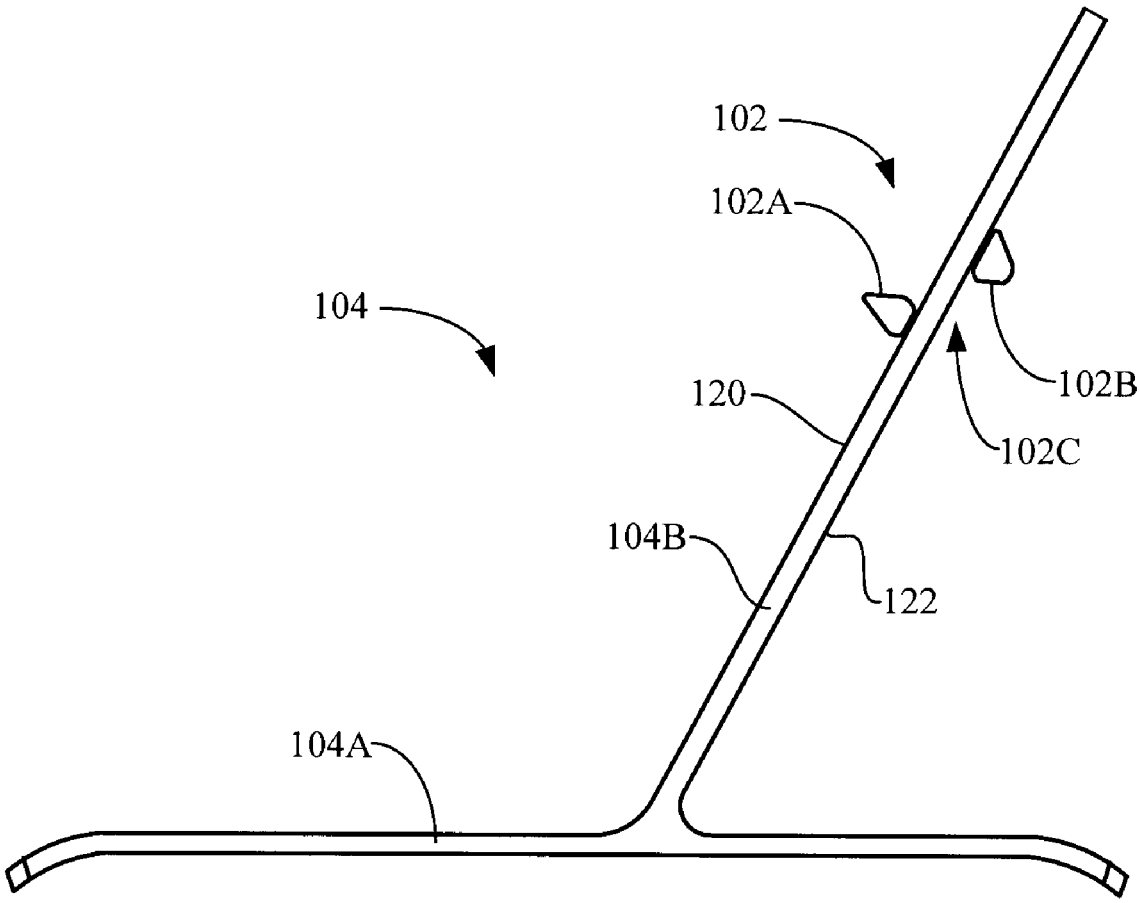
FIG. 7 shows an elevational end view of the parallel backbone members and the support leg of the inventive open architecture public seating system of FIG. 1.

FIG. 5 provides a more clear presentation of the combination seating surface and backrest portion 106, which provides a sliding engagement area 107 configured for sliding engagement with the pair of parallel backbone members 102, via the pair of mounting apertures 109, and adjacent support leg 104 with sliding engagement area 107 of the inventive open architecture seating system 100 when the end cap 108 and removable fasteners 110 are removed. FIG. 6 provides a partial cut-away top perspective exploded view of the sliding engagement area 107 with the end cap 108 and removable fasteners 110 detached from the inventive open architecture public seating system. The directional line 111 depicts the movement direction for a unitary combination seating surface and backrest portion 106, a support leg 104, an end cap 108, and removable fasteners 110 relative to the pair of parallel backbone members 102.

FIG. 6 provides an elevational end view of the parallel backbone members 102 and the support leg 104 of the inventive open architecture public seating system of FIG. 1. The backbone members 102 are respectively denoted at 102A and 102B, and are separated by an intervening gap 102C. The support leg 104 is shown to include a base portion 104A configured to rest on an underlying floor surface, and a leg portion 104B which extends from the base portion 104A at a non-orthogonal angle with respect to the base portion. The leg portion 104B includes opposing first and second surfaces 120, 122. During assembly, the leg portion 104B slidingly engages the backbone members 102A, 102B along the gap 102C so that the first surface 120 is brought into mating contact with the first backbone member 102A, and the second surface 122 is brought into mating contact with the second backbone member 102B. It is noted that the inventive open architecture public seating system of FIG. 6 includes an armrest 124, also shown in FIGS. 2, 3, 4, and 5, attached to the unitary combination seating surface and backrest portion 106, which forms no portion of end cap 108, and that end cap 108 forms no portion of armrest 124.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

It will be clear that the present invention is well adapted to attain the ends and advantages mentioned as well as those inherent therein. While presently preferred embodiments have been described for purposes of this disclosure, numerous changes may be made which will readily suggest themselves to those skilled in the art and which are encompassed by the appended claims. For example, a doublewide armrest may be provided to accommodate the needs of individuals seated adjacent one another, or armrests may be excluded altogether. Various architectural and design themes may be expressed in the presentation of the seating and backrest portions.

What is claimed is:

1. An apparatus comprising:

a pair of parallel backbone members comprising first and second backbone members separated by a gap therebetween;

a support leg in sliding engagement with the pair of parallel backbone members along said gap, the support leg comprising opposing first and second surfaces wherein the first surface matingly contacts the first backbone member and the second surface matingly contacts the second backbone member;

a unitary combination seating surface and backrest portion in sliding engagement with the pair of parallel backbone members and adjacent the support leg; and an end cap secured to each of the pair of parallel backbone members and restricting lateral motion of the support leg and the combination seating surface and backrest portion, wherein upon removal of the end cap both the support leg and the combination seating surface and backrest portion are free to slide laterally along the pair of parallel backbone members, and wherein the end cap is separate and distinct from both the support leg and the unitary combination seating surface and backrest portion, said end cap further forms no portion of an arm rest which attaches directly to said unitary combination seating surface and backrest portion.

2. The apparatus of claim 1, wherein the support leg comprises a base portion configured to rest upon a floor surface and a leg portion which extends upwardly from the base portion at a non-orthogonal angle with respect to the base portion.

3. The apparatus of claim 1, wherein said support leg further comprises an armrest.

4. The apparatus of claim 1, wherein said combination seating and backrest surface comprises an armrest.

5. The apparatus of claim 1, wherein said end cap is attached to said first backbone member by a first fastener and said second backbone member by a second fastener.

6. The apparatus of claim 1, made by steps comprising:

supporting the first backbone member and the second backbone member in a parallel relation;

sliding the support leg between the first and second backbone members; and sliding the unitary combination seating surface and backrest portion onto the first and second backbone members rigidly affix the first and second backbone members with respect to the support leg.

7. The apparatus of claim 1, wherein said combination seating surface and backrest portion comprises a seating surface and a backrest surface, and wherein said combination seating surface and backrest portion further has a sliding engagement area between the seating surface and the backrest surface.

8. The apparatus of claim 7, wherein said sliding engagement area comprises a first mounting aperture for sliding engagement with said first backbone member and a second mounting aperture for sliding engagement with said second backbone member.

9. The apparatus of claim 1, wherein said combination seating surface and backrest portion is characterized as a first combination seating surface and backrest portion, and wherein the apparatus further comprises a second combination seating surface and backrest portion nominally identical to the first combination seating surface and backrest portion and which slidingly engages the first and second backbone members.

10. The apparatus of claim 9, wherein the support leg is disposed between the first combination seating surface and backrest portion and the second combination seating surface and backrest portion.

11. An apparatus comprising:

a first backbone member in a spaced apart relation to a second backbone member to form a gap therebetween;

a support leg having a leg portion which extends into said gap to slidingly engage and contact the first backbone member and the second backbone member;

a combination seating surface and backrest portion which slidingly engages and contacts the first backbone member and the second backbone member; and an end cap which restricts sliding motion of the support leg and the combination seating surface and backrest portion with respect to the first and second backbone members, and in which said end cap further forms no portion of an arm rest, wherein said armrest attaches directly to said unitary combination seating surface and backrest portion.

12. The apparatus of claim 11, wherein the leg portion comprises opposing first and second surfaces, the first surface contactingly engaging the first backbone member and the second surface concurrently contactingly engaging the second backbone member.

13. The apparatus of claim 11, wherein the support leg further comprises a base portion configured to rest upon a floor surface, wherein the leg portion extends upwardly from the base portion at a non-orthogonal angle with respect to the base portion.

14. The apparatus of claim 13, wherein an arm rest extends from the leg portion opposite the base portion.

15. The apparatus of claim 11, wherein said end cap is attached to said first backbone member by a first fastener and said second backbone member by a second fastener.

16. The apparatus of claim 11, wherein the first and second backbone members are rigidly secured against the leg portion without the use of a fastener.

17. The apparatus of claim 11, wherein removal of the end cap allows sliding disengagement of the support leg and the combination seating surface and backrest portion from the leg portion without requiring removal of at least one fastener.

18. The apparatus of claim 11, made by steps comprising:

supporting the first backbone member and the second backbone member in a parallel relation;

sliding the leg portion between the first and second backbone members; and sliding the combination seating surface and backrest portion onto the first and second backbone members rigidly affix the first and second backbone members with respect to the support leg.

19. The apparatus of claim 11, wherein said combination seating surface and backrest portion is characterized as a first combination seating surface and backrest portion, and wherein the apparatus further comprises a second combination seating surface and backrest portion nominally identical to the first combination seating surface and backrest portion and which slidingly engages the first and second backbone members.

20. The apparatus of claim 19, wherein the leg portion is disposed between the first combination seating surface and backrest portion and the second combination seating surface and backrest portion.

* * * * *